US009283749B2

(12) United States Patent
Hamada et al.

(10) Patent No.: US 9,283,749 B2
(45) Date of Patent: Mar. 15, 2016

(54) LIQUID EJECTING METHOD, LIQUID EJECTING DEVICE, AND LIQUID EJECTING SYSTEM

(71) Applicant: CANON KABUSHIKI KAISHA, Tokyo (JP)

(72) Inventors: Yoshihiro Hamada, Yokohama (JP); Michinari Mizutani, Kawasaki (JP); Yasunori Takei, Tokyo (JP); Toshikazu Nagatsuka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/627,612

(22) Filed: Feb. 20, 2015

(65) Prior Publication Data

US 2015/0239240 A1 Aug. 27, 2015

(30) Foreign Application Priority Data

Feb. 27, 2014 (JP) ..... 2014-037423

(51) Int. Cl.
*B41J 2/045* (2006.01)

(52) U.S. Cl.
CPC ..... *B41J 2/04563* (2013.01); *B41J 2/0458* (2013.01); *B41J 2/04591* (2013.01); *B41J 2/04598* (2013.01)

(58) Field of Classification Search
USPC ..... 347/9, 10, 11, 12, 13, 14
See application file for complete search history.

(56) References Cited

U.S. PATENT DOCUMENTS 6,070,969 A * 6/2000 Buonanno ..... 347/64
2006/0170717 A1* 8/2006 Kondoh ..... 347/5

FOREIGN PATENT DOCUMENTS

JP 2002-321369 A 11/2002

* cited by examiner

*Primary Examiner* — Huan Tran
(74) *Attorney, Agent, or Firm* — Fitzpatrick, Cella, Harper & Scinto

(57) ABSTRACT

Provided are a liquid ejecting method, a liquid ejecting device, and a liquid ejecting system which can avoid damage of an electro-thermal conversion element caused by cavitation and can prolong a life thereof even in a case that handling with a configuration of an ejecting port is difficult. For that purpose, ejection is performed for a low-duty region by controlling such that variation in an ejection speed is made smaller, and ejection is performed for a high-duty region by controlling such that variation in the ejection speed is made larger.

7 Claims, 9 Drawing Sheets

| TABLE NO. / CONDITION | ( 1 ) | ( 2 ) | ( 3 ) | ( 4 ) | ( 5 ) |
|---|---|---|---|---|---|
| HEAD TEMPERATURE $T_H$ (°C) | LESS THAN 25 | 25~30 | 30~40 | 40~50 | 50 OR MORE |
| PRE-PULSE WIDTH $P_1$ (μsec) | 0.40 OR MORE | 0.35 | 0.30 | 0.25 | 0.20 OR LESS |

FIG.5

LIQUID EJECTING METHOD, LIQUID EJECTING DEVICE, AND LIQUID EJECTING SYSTEM

BACKGROUND OF THE INVENTION

1. Field of the Invention

The present invention relates to a liquid ejecting method, a liquid ejecting device, and a liquid ejecting system for foaming and ejecting a liquid by heat generated by an electro-thermal conversion element.

2. Description of the Related Art

Representative ejecting methods in a liquid ejecting head mounted on a liquid ejecting device include a liquid ejecting head using an electro-thermal conversion element. This liquid ejecting head has the electro-thermal conversion element provided in a liquid chamber and applies thermal energy to the liquid by supplying an electric pulse which is a print signal to the electro-thermal conversion element for heat generation. Then, by using an air-bubble pressure at the time of foaming (boiling) of the liquid generated by a phase change of the liquid in a case that the thermal energy is applied, a liquid (hereinafter also referred to as ink) is ejected to a sheet from a micro ejecting port. In this liquid ejecting head using the electro-thermal conversion element, at the time of defoaming of the air bubbles generated by heating the ink with the electro-thermal conversion element, the liquid rapidly flows in at a disappearance point, and cavitation occurs. This cavitation generates an impact force on the electro-thermal conversion element.

FIG. 9 is a schematic diagram of a vicinity of an ejecting port of a prior-art liquid ejecting head seen from a front. In a configuration in which a center line of an ink channel 5 for supplying ink to the ejecting port matches a center line of an electro-thermal conversion element 1, a flow of the ink from a common liquid chamber 8 toward a pressure chamber 7 through the ink channel 5 is generated symmetrically with respect to the center line of the electro-thermal conversion element 1. Thus, the air bubbles generated by heating the ink with the electro-thermal conversion element 1 are stably defoamed symmetrically with respect to the center line on the electro-thermal conversion element 1. In the configuration in which a defoaming position is stable as above, a specific spot in the electro-thermal conversion element receives the impact force caused by the cavitation, and thus, there is a problem that the electro-thermal conversion element 1 is easily damaged, and a durability life becomes short.

On the contrary, Japanese Patent Laid-Open No. 2002-321369 proposes a configuration in which the pressure chamber has a columnar shape, the center line of the ink channel is offset to the center of the electro-thermal conversion element and moreover, the center of the ejection port is offset from the center of the electro-thermal conversion element to the common liquid chamber side. With this configuration, the ink flow from the common liquid chamber through the ink channel toward the pressure chamber washes away the air bubbles to a position biased to a side of the electro-thermal conversion element. Then, at this biased position, final defoaming can be made to occur in a relatively wide region extending vertically in the vicinity of a side edge of the pressure chamber, whereby cavitation generation regions are distributed, and an influence of the cavitation can be reduced.

However, with a recent trend to an ejecting port with higher density in order to obtain high definition print, it is difficult to constitute the pressure chamber having a columnar shape. Moreover, in order to handle improvement of a print speed and ink with viscosity higher than before, the ink channel needs to be widened, and a method of controlling the ink flow by the configuration of the ejecting port and of distributing the cavitation generation regions has become difficult.

SUMMARY OF THE INVENTION

Therefore, the present invention provides a liquid ejecting method, a liquid ejecting device, and a liquid ejecting system which can avoid damage of the electro-thermal conversion element caused by cavitation and can prolong its life even in a case that the problem cannot be easily handled by the configuration of the ejecting port.

A liquid ejecting device of the present invention is a liquid ejecting device including: an ejecting unit provided with an electro-thermal conversion element and configured to eject a liquid to a medium by applying electric energy to the electro-thermal conversion element; a determining unit configured to determine whether a region of the medium to which the liquid is ejected by the ejecting unit is a first region or a second region with a number of ejections per unit area smaller than that of the first region; and a control unit configured to control ejection by the ejecting unit by changing magnitude of the electric energy to be applied to the electro-thermal conversion element, wherein the control unit makes the electric energy to be applied to the electro-thermal conversion element relatively larger for the ejection to the region determined by the determining unit to be the first region and makes the electric energy to be applied to the electro-thermal conversion element relatively smaller for the ejection to the region determined by the determining unit to be the second region.

According to the present invention, ejection is performed for a low-duty region by controlling such that variation in an ejection speed is made smaller, and ejection is performed for a high-duty region by controlling such that variation in the ejection speed is made larger. This makes it possible to realize the liquid ejecting method, the liquid ejecting device, and the liquid ejecting system which can avoid damage of the electro-thermal conversion element caused by the cavitation and can prolong its life.

Further features of the present invention will become apparent from the following description of exemplary embodiments (with reference to the attached drawings).

BRIEF DESCRIPTION OF THE DRAWINGS

FIG. 5 is a table illustrating a relationship between a temperature of the liquid ejecting head and an optimal pulse width;

DESCRIPTION OF THE EMBODIMENTS

First Embodiment

A first embodiment of the present invention will be described below by referring to the attached drawings.

Figure 1:
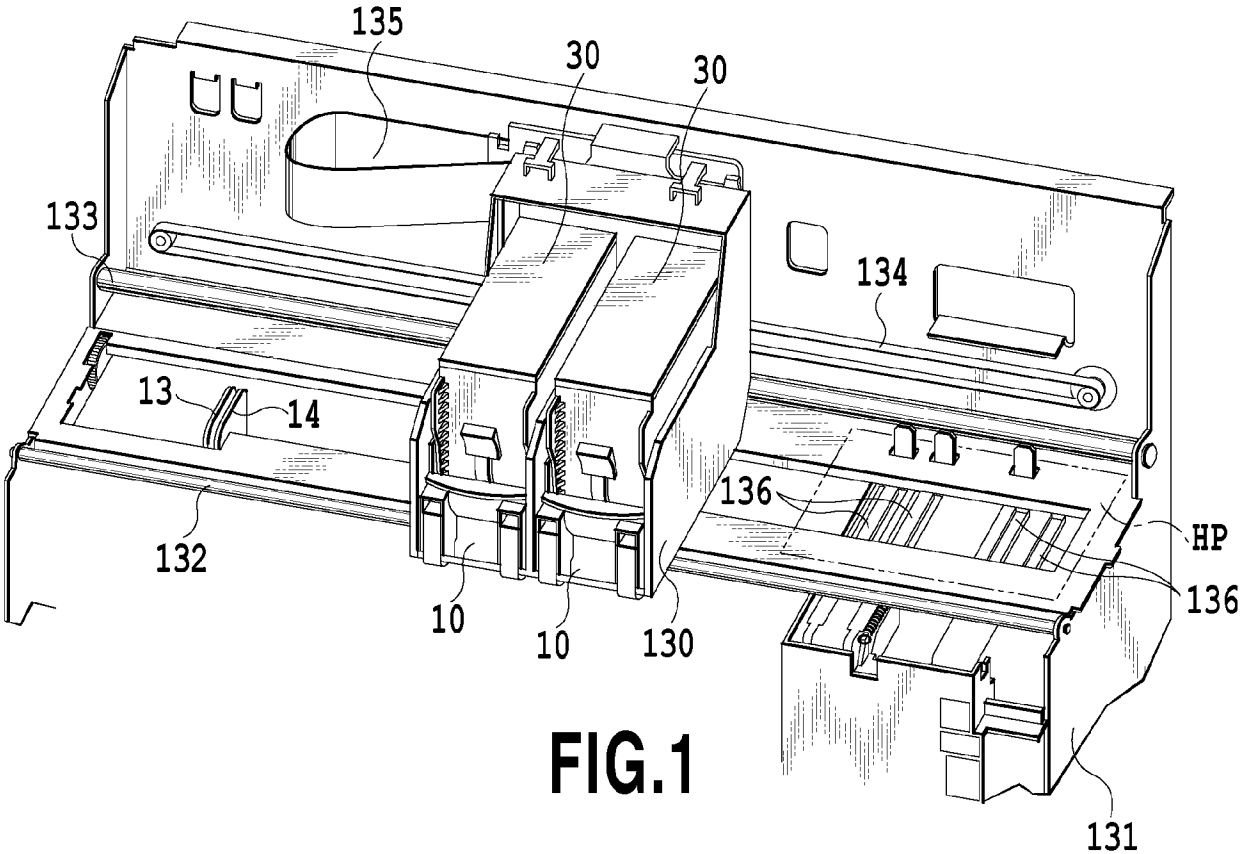
FIG. 1 is a perspective view illustrating an inkjet print device.

FIG. 1 is a perspective view illustrating an inkjet print device according to the embodiment of the present invention. A carriage 130 is capable of mounting two liquid ejecting heads (hereinafter referred to simply as heads) 10 and two liquid cartridges 30. In one of the two liquid ejecting heads 10, a predetermined number of ejecting ports for ejecting cyan ink, magenta ink, and yellow ink, respectively, are formed integrally, and accordingly the ink cartridge stores the above-described three types of ink individually.

The other liquid ejecting head 10 is configured to eject black ink and for that purpose, the other ink cartridge 30 stores black ink. The carriage 130 has its both end portions supported by a chassis 131 and is supported slidably by extending guide rails 132 and 133. To this carriage 130, a driving belt 134 for transmitting driving from a driving motor, not shown, and a flexible cable 135 for transmitting an image signal to the mounted liquid ejecting head 10 are connected, respectively. As a result, the ink can be ejected from each of the liquid ejecting heads 10 to a print sheet, for example, as a sheet for performing print.

At a home position HP provided on one end side in a moving range of the carriage, a cap (capping unit) 136 used for suctioning or protection is provided for the purpose of ejection restoration of the liquid ejecting head 10 mounted on the carriage 130. In the ejection restoration, a pressure in a space between the cap 136 and a head portion is made negative by a pump (pump unit), not shown, or preliminary ejection is performed to the cap 136. As a result, clogging and the like in the ejecting port or an ink channel (ejecting port) communicating with that can be positively solved. Though not shown, on the cap 136, an ink tube communicating with an inside thereof and guiding the ink ejected from the liquid ejecting head 10 to a predetermined portion is mounted.

Figure 2:
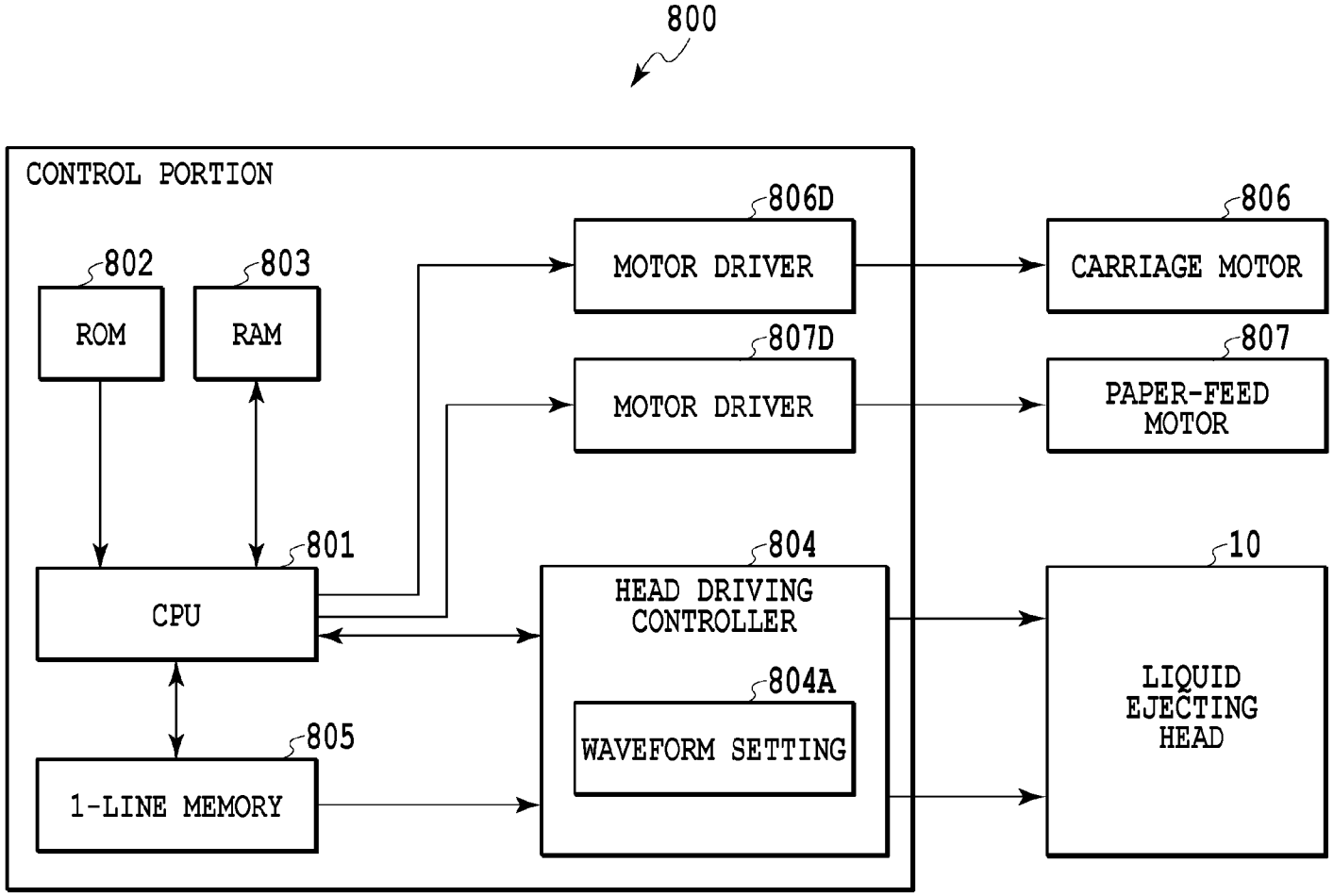
FIG. 2 is a block diagram illustrating a control configuration of a liquid ejecting device illustrated in FIG. 1.

FIG. 2 is a block diagram illustrating a control configuration of the liquid ejecting device illustrated in FIG. 1. A control portion 800 has a CPU 801 executing processing of print data, operation control processing and the like of each mechanism and executes control relating to this print device. A ROM 802 stores a processing program by the CPU 801, and a RAM 803 is used as a work area for processing executed by the CPU 801. Moreover, the CPU 801 can control driving of a carriage motor 806 and a paper-feed motor 807 through each of motor drivers 806D and 807D.

Driving control of each of the liquid ejecting heads illustrated in FIG. 1 is executed by a head controller 804 on the basis of the control of the CPU 801. That is, the head controller 804 supplies binary ejection data stored in 1-line memory corresponding to each of the ejecting ports of the liquid ejecting head 10 to a driver of the liquid ejecting head 10 in accordance with timing of movement of the carriage 130. Then, the ink is ejected from the liquid ejecting head 10 on the basis of this.

In a first embodiment of the present invention, a split driving pulse method is used as a driving control method for performing ejection.

Figure 3A:
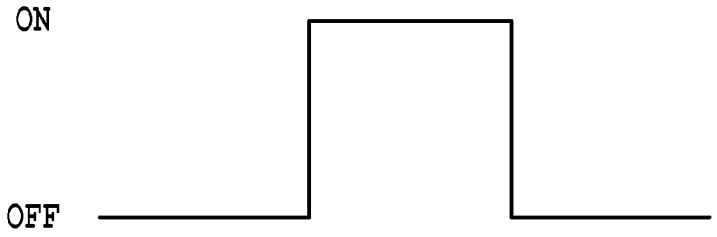
FIG. 3A is a diagram illustrating a driving pulse input into an electro-thermal element.
Figure 3B:
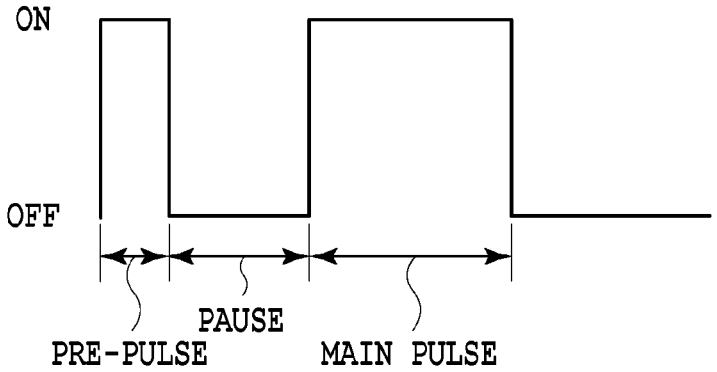
FIG. 3B is a diagram illustrating the driving pulse input into the electro-thermal element.

FIGS. 3A and 3B are diagrams illustrating driving pulses (electric energy) to be input into an electro-thermal element. The split driving pulse method is a method not configured such that 1 pulse is applied as in FIG. 3A (hereinafter referred to as a single pulse) but configured such that a short pulse (hereinafter referred to as a pre-pulse) of such a degree that a liquid is not foamed is applied before an ejection pulse (hereinafter referred to as a main pulse) as in FIG. 3B (hereinafter referred to as a double pulse). By performing ejection in combination of the pre-pulse and the main pulse as above, a substantially constant droplet amount can be injected at all times regardless of a change in an outside air or a temperature of the liquid ejecting head. Here, a period of time from a fall of the pre-pulse to a rise of the main pulse in the split driving pulse method is called a pause.

Figure 4A:
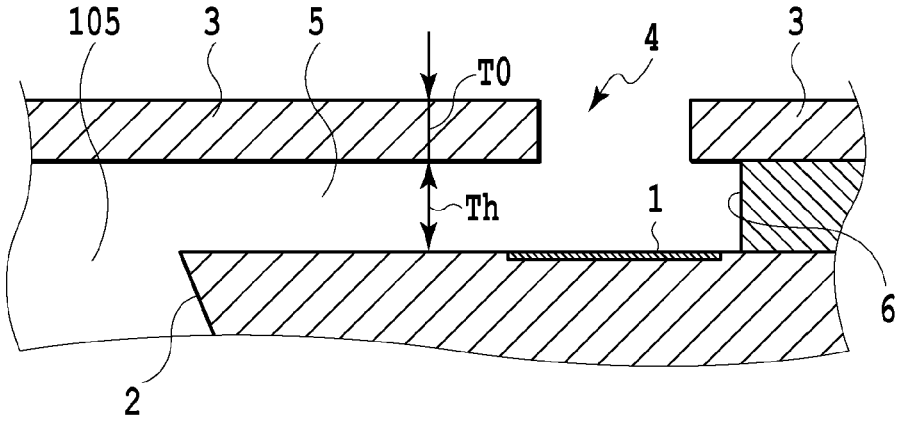
FIG. 4A is a diagram illustrating an outline configuration of an ejecting portion of a liquid ejecting head.
Figure 4B:
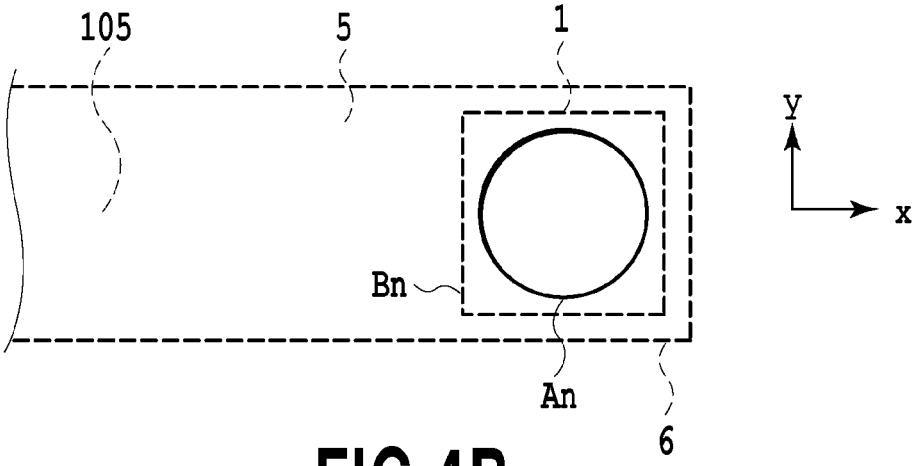
FIG. 4B is a diagram illustrating an outline configuration of the ejecting portion of the liquid ejecting head.

FIGS. 4A and 4B are diagrams illustrating outline configurations of the ejecting portion of the liquid ejecting head 10 according to this embodiment, in which FIG. 4A is a sectional view of the ink ejecting port seen from a side, and FIG. 4B is a front view of the ejecting port seen from the front. The liquid ejecting head 10 of this embodiment has 512 ejecting ports arrayed with density of 600 dpi, and a volume of an ink droplet ejected from each of the ejecting ports is 12.0 pl. At a predetermined position on an element substrate 2, the rectangular electro-thermal conversion element 1 is provided as an electro-thermal conversion element. Above this element substrate 2, an orifice plate 3 is disposed in parallel with the element substrate 2, and this orifice plate 3 has an ejecting port 4 open having a circular shape at a position facing the electro-thermal conversion element 1.

A space surrounded by the element substrate 2, the orifice plate 3, and a liquid channel wall 6 forms a communication path 105 and the liquid channel 5 communicating therewith. As illustrated in FIG. 4B, the liquid channel 5 extends in an arrow x-direction illustrated in the figure, and in this case, the ejecting ports 4 are arrayed in plural in an arrow y-direction. The liquid ejecting head 10 of this embodiment has a configuration similar to the configuration illustrated in (a) and (b) in FIG. 6, symmetrically with respect to an axis in the arrow y-direction. That is, two rows of the ejecting ports 4 arrayed in the arrow y-direction are formed.

In the liquid ejecting head 10 of this embodiment, a channel height Th illustrated in FIG. 4A is 20 μm, a thickness To of the orifice plate 3 is 23 μm and a size of the electro-thermal conversion element is a 30-μm square, and an area Sn of the electro-thermal conversion element is 900 $\mu m^2$. An area An of the ejecting port illustrated in FIG. 4B is 316 $\mu m^2$ and, in a case that a voltage of 24 V is applied to the electro-thermal conversion element 1, a volume ejected from the liquid ejecting head is 12.0 pl.

Subsequently, application of a voltage pulse (having a pulse-shaped waveform) to the electro-thermal conversion element 1 so as to control a pulse width by input energy will be described in relation to this embodiment.

FIG. 5 is a table illustrating a relationship between a temperature of the liquid ejecting head and an optimal pulse width in a case that the split driving pulse method is used as the ejection control method and illustrates a relationship of the optimal pulse width to the temperature of the liquid ejecting head 10 by the pre-pulse in a region with a stable ejection speed. In the split driving pulse method, with variation in the temperature of the liquid ejecting head 10, by matching the pre-pulse width with values indicated in table numbers (1) to (5) corresponding to temperatures of each of the liquid ejecting heads, ejection can be performed in the stable ejection speed state, even in the case where the temperature of the liquid ejecting head is varied.

Figure 6:
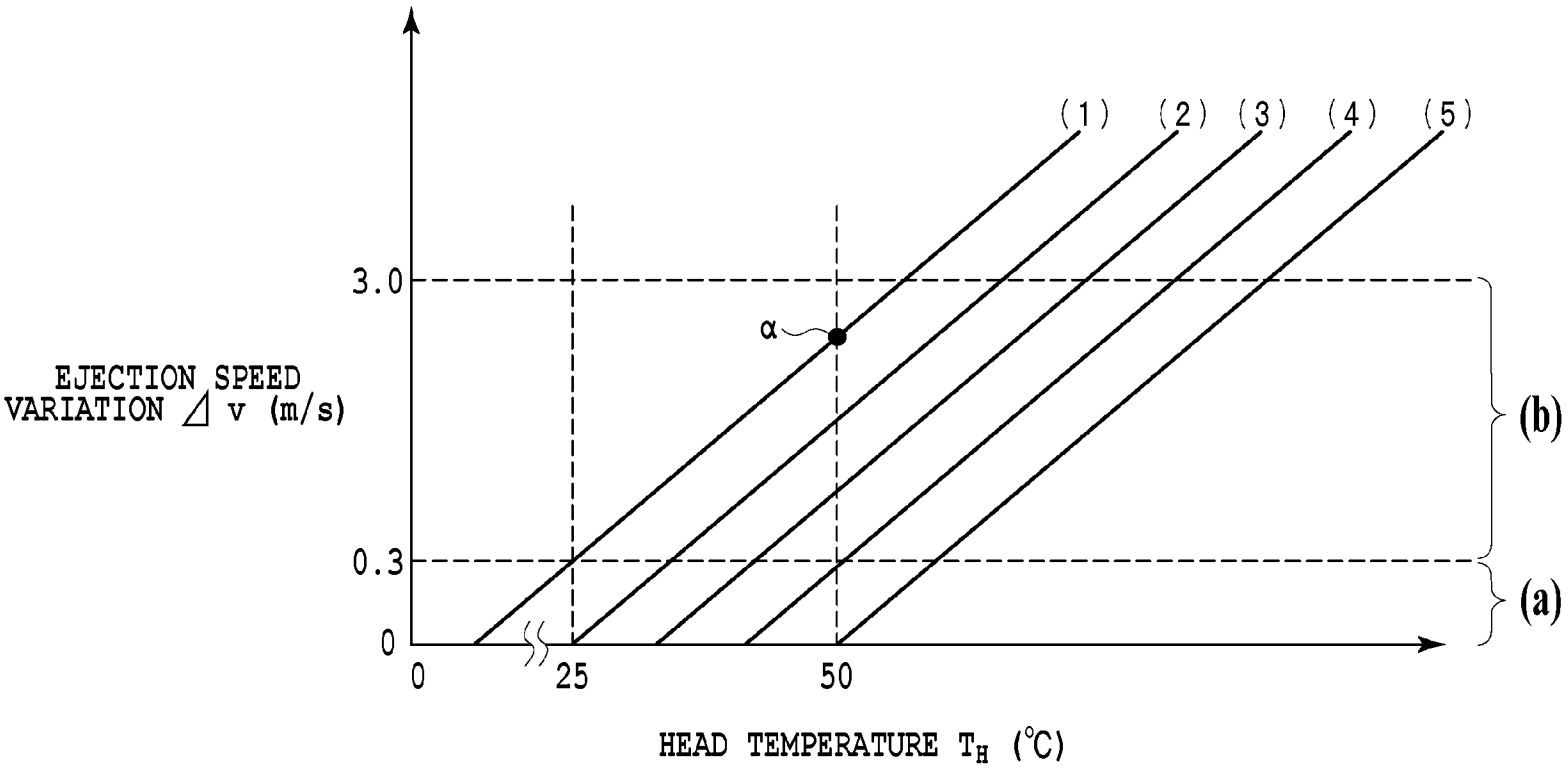
FIG. 6 is a graph illustrating a relationship between the temperature of the liquid ejecting head and variation in an ejection speed.

FIG. 6 is a graph illustrating a relationship between the temperature of the liquid ejecting head and the ejection speed variation in the case that the split driving pulse method is used as the ejection control method. Numbers (1) to (5) in FIG. 6 correspond to the table numbers (1) to (5) in FIG. 5. In a region (a) in FIG. 6, by controlling the pre-pulse to the optimal pulse width in accordance with the temperature of the liquid ejecting head 10 as illustrated in FIG. 5, variation in the ejection speed can be suppressed. Thus, stable ejection is made possible, and deviation of a landing position on a medium subjected to the ejection hardly occurs in this region (hereinafter referred to as a landing accuracy preferred region). Since a foaming state is made stable by applying optimal energy according to the temperature of the liquid ejecting head to the ink, the deviation of the landing position is made difficult to occur.

On the other hand, a region (b) in FIG. 6 is a region where variation in the ejection speed is large and a region where the landing position deviation can occur relatively easily (hereinafter referred to as a durability preferred region) by controlling the pre-pulse to such a pulse width that applies excessive energy with respect to the head temperature. Since the foaming state is unstable by giving the excessive energy to the ink, the landing position deviation can occur easily. Moreover, the foaming state is made unstable because small bubbles not generated in a case that ejection control is executed with the optimal pulse width are generated in the pressure chamber by giving the excessive energy.

Figure 7A:
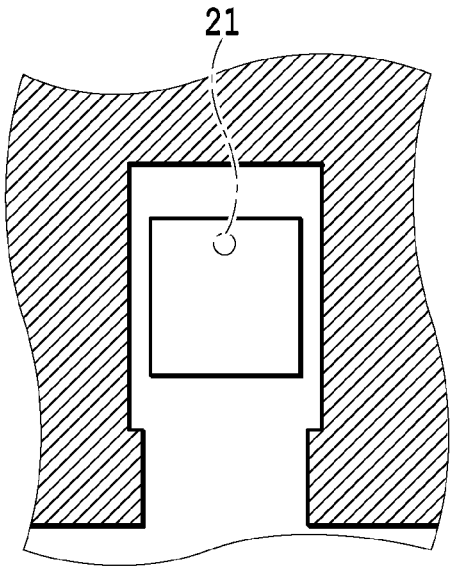
FIG. 7A is a diagram schematically illustrating a defoamed region of air bubbles.
Figure 7B:
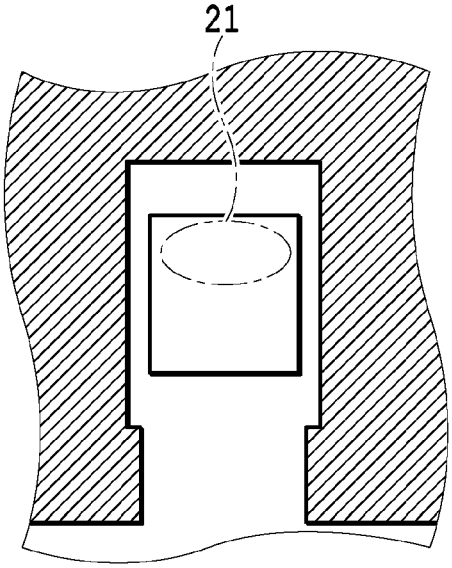
FIG. 7B is a diagram schematically illustrating the defoamed region of the air bubbles.

FIGS. 7A and 7B are views schematically illustrating regions where bubbles are defoamed after an ink droplet is ejected. FIG. 7A illustrates a case in which ejection is controlled in the region (a) in FIG. 6, and the pre-pulse is controlled to the optimal pulse width in accordance with the temperature of the liquid ejecting head, and since foaming is stable, the defoamed regions concentrate to a specific spot. In a case that the defoamed regions concentrate as above, cavitation also occurs in a concentrated manner in this region. On the other hand, FIG. 7B illustrates a case in which the ejection is controlled in the region (b) in FIG. 6, and excessive energy is applied to the head temperature, but since the foamed state is unstable, the defoamed regions are distributed. In the case that the defoamed regions are distributed as above, cavitation also occurs in a distributed manner in this region.

In this embodiment, control of switching between the ejection control using the landing accuracy preferred region controlled as above and the ejection control using the durability preferred region in accordance with the number of pixels which are ON in a unit region of binary image data, that is, so-called duty is executed. The duty also corresponds to the number of ejections per unit area and an ink applied amount per unit area. Here, a high-duty region and a low-duty region in the image data used for the control are defined. The high-duty region is a predetermined region in the binary image data and refers to a portion in which ½ or more of the pixels are ON (ejection) data in that region. On the other hand, the low-duty region is a predetermined region in the binary image data and refers to a portion in which less than ½ of the pixels are on (ejection) data in that region.

A specific driving control method in this embodiment will be described. The CPU 801 counts the number of pieces of ON (ejection) data in the case where the print data for 1 line is stored in a 1-line memory 805 from a predetermined buffer and stores this in a predetermined memory of the head driving controller 804. Then, in the case where the ejection data stored in the 1-line memory 805 is to be transferred to the liquid ejecting head 10, it is determined whether or not the duty obtained on the basis of the count number is at reference duty set in advance or more (relatively larger).

This determination is made to determine whether it is high duty or low duty, and as described above in a predetermined region, determination is made on whether the pixels are ON data in ½ or more of the pixels in that region. In accordance with the determination on the duty as above, a waveform signal of the driving pulse is sent from a waveform setting portion 804A to the driver of the liquid ejecting head 10 as described above, and the electro-thermal conversion element 1 is driven by the driving pulse with the pulse width or a voltage value according to the duty.

In the inkjet print device of this embodiment, as described above in a predetermined region, high duty and low duty are discriminated by whether the pixels to be ON (ejection) in that region are ½ or more or less in the binary image data, but this is not limiting. With regard to this determination base, by examining a relationship between the ejection speed variation and an image quality for each of some duties in advance, a determination basis can be set on the basis of that (by obtaining the information). In addition, the determination base can be changed in accordance with an ejection amount, ejecting port density, a carriage moving speed, an ejection frequency and the like, for example.

In the ejection control using the split driving pulse method in this embodiment, the ejection control in the stable ejection speed state (condition described in FIG. 5) is executed for print to a low-duty region, while the ejection control in the state in which the ejection speed is relatively unstable is executed for print to a high-duty region. That is, for the print to the low-duty region, the ejection control corresponding to the region (a) in FIG. 6 is executed, while for the print to the high-duty region, the ejection control corresponding to the region (b) in FIG. 6 is executed. In the print to the high-duty region, even in the case where the ejection in the state in which the ejection speed is relatively unstable is performed and variation in the landing position becomes large, there are few isolated dots formed, and the landing position deviation is not noticeable. Thus, the image quality is less affected, and high-quality image formation is possible.

Figure 8A:
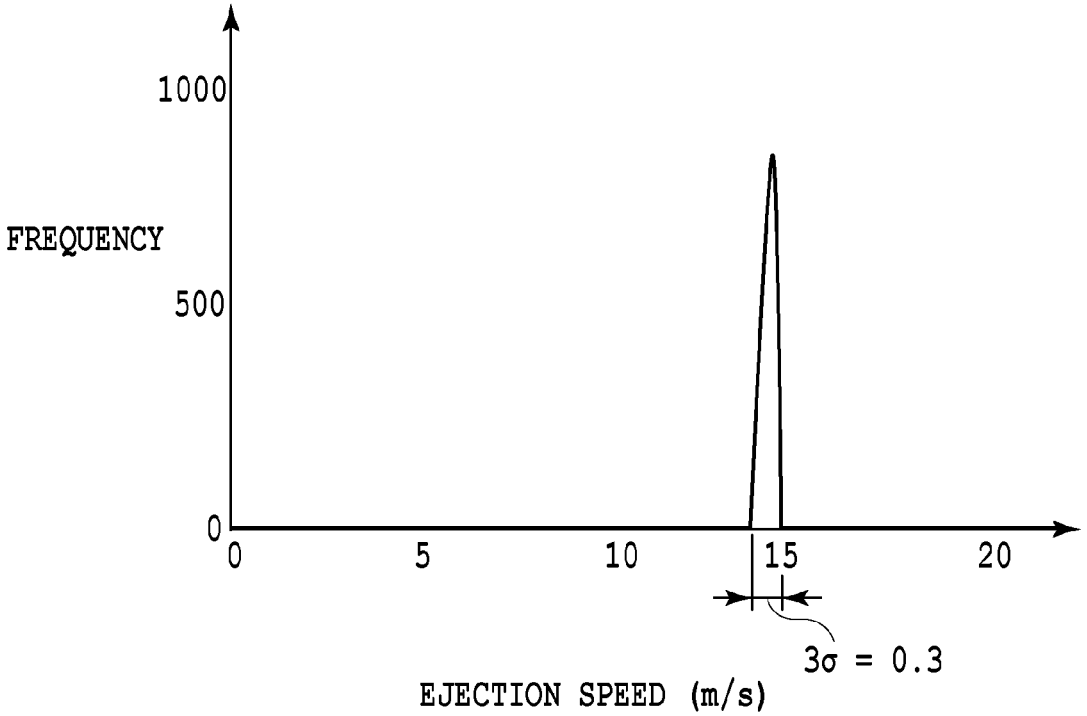
FIG. 8A is a diagram illustrating ejection speed distribution in a case of continuous ejection.
Figure 8B:
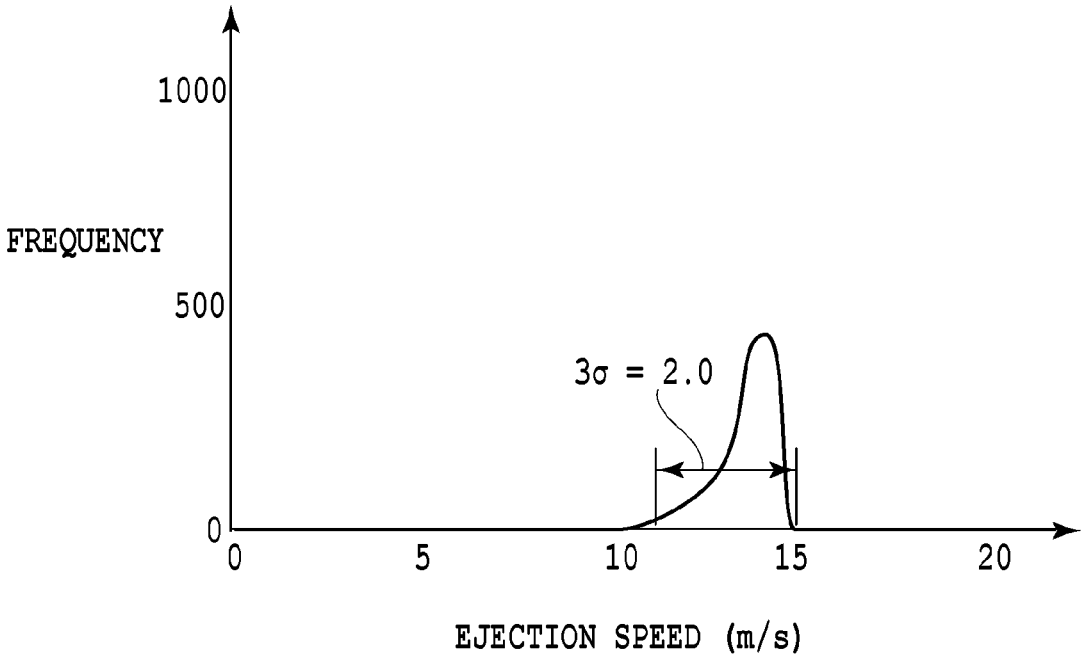
FIG. 8B is a diagram illustrating the ejection speed distribution in the case of continuous ejection.
Figure 9:
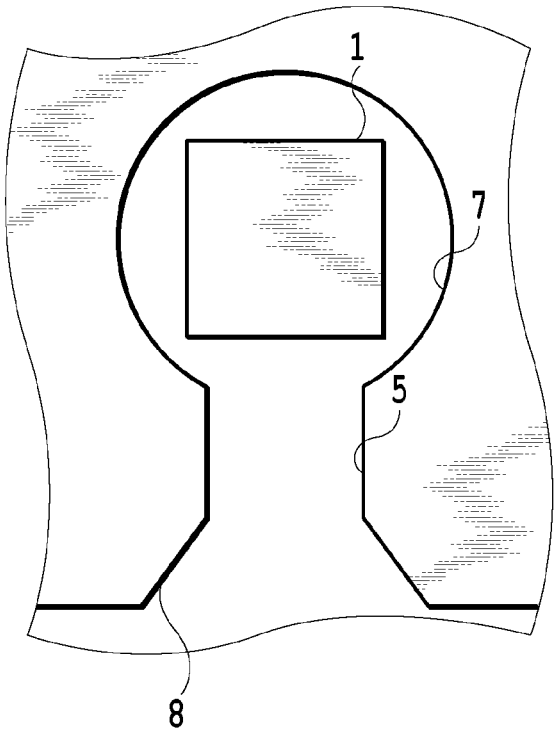
FIG. 9 is a schematic view of a vicinity of an ejecting port of a prior-art liquid ejecting head seen from a front.

FIGS. 8A and 8B are diagrams illustrating ejection speed distribution in the case where continuous ejection at a driving frequency of 10 kHz for 1000 times was performed in the ejection control using the split driving pulse method in this embodiment. The ink with viscosity of 3.0 mPa·s and surface tension of 37.0 mN/m was used in this case, and the head temperature was adjusted to 50° C.

For the print to the low-duty region, since the pre-pulse width is 0.2 in a case that the head temperature is 50° C. under a condition in the table in FIG. 5, driving was performed with a double pulse at a voltage of 24 V, the pre-pulse width of 0.2 μsec, a pause of 1.0 μsec, and the main pulse width of 0.8 μsec.

As a result, the stable ejection state with less variation ($3\sigma=0.3$) in the ejection speed was obtained at an average ejection speed of 14.0 m/s as illustrated in FIG. 8A.

On the other hand, for the print to the high-duty region, the pre-pulse width was set to 0.4 (corresponding to a point α in the region (b) in FIG. 6), and driving was performed with a double pulse at a voltage of 24 V, the pre-pulse width of 0.4 μsec, a pause of 1.0 μsec, and the main pulse width of 0.8 μsec.

As a result, the ejection state with variation in which the variation in the ejection speed is relatively unstable ($3\sigma=2.0$) was obtained at an average ejection speed of 14.0 m/s as illustrated in FIG. 8B.

The temperature adjusting method of the liquid ejecting head may be any method, and an electro-thermal conversion element for temperature adjustment not used for ink ejection may be provided in the liquid ejecting head, for example.

As described above, for the print to the low-duty region, the ejection control with stable ejection speed is executed, while for the print to the high-duty region, the ejection control with unstable ejection speed is executed. As a result, the defoamed regions are concentrated to a specific spot for the print to the low-duty region, while the defoamed regions are distributed for the print to the high-duty region.

By configuring as above, landing on an accurate position can be obtained by stable ejection for the print to the low-duty region, a high quality image without white stripes or voids can be obtained, and high-quality image formation of ruled lines and characters can be realized. For the print to the high-duty region, the regions where cavitation occurs are distributed without lowering the print quality, concentrated damage on the electro-thermal conversion element can be prevented, and the life can be prolonged.

As described above, by using different ejection control for the low duty and the high duty, the liquid ejecting method, the liquid ejecting device, and the liquid ejecting system which can prolong the life of the electro-thermal conversion element while maintaining the high quality image, can be realized.

Second Embodiment

A second embodiment of the present invention will be described below by referring to the attached drawings. Since the basic configuration of this embodiment is similar to that of the first embodiment, only characteristic configuration will be described below.

The ejecting port of the liquid ejecting head of this embodiment has the thickness To of the orifice plate at 23 μm and the channel height Th at 20 μm similarly to the first embodiment. However, the electro-thermal conversion element has, unlike the first embodiment, a rectangular shape of 26 μm×31 μm, and the element with the area Sn of the electro-thermal conversion element of 806 $\mu m^2$ and the area An of the ejecting port of 314 $\mu m^2$ is used. In a case that the voltage of 24 V is applied to the electro-thermal conversion element with this ejecting port, a volume of the ink droplet ejected from the head is 12.0 pl.

The driving control method in ejection of this embodiment uses a single pulse method for the low-duty region and the split driving pulse method for the high-duty region.

In the ejection control in the low-duty region, driving is performed with a single pulse at the voltage of 24 V and the pulse width of 1.0 μsec. As a result, the ejection state with stable ejection speed ($3\sigma=0.2$) at the average ejection speed of 11.0 m/s can be obtained. On the other hand, in the ejection control in the high-duty region, driving is performed with a double pulse at the voltage of 24 V, the pre-pulse width of 0.35 μsec, a pause of 1.0 μsec, and the main pulse width of 0.9 μsec. As a result, the ejection state with the average ejection speed of 13.0 m/s has large variation in the ejection speed ($3\sigma=2.2$). The ink with viscosity of 2.8 mPa·s and surface tension of 36.0 mN/m was used in this case, and the head temperature was adjusted to 53° C.

In this embodiment, the case in which the single pulse method is used for the low-duty region and the split driving pulse method is used for the high-duty region is described, but this is not limiting. A characteristic matter of the present invention is to perform ejection by executing the control such that variation in the ejection speed becomes less for the low-duty region and to perform ejection by executing the control such that the variation in the ejection speed becomes large for the high-duty region. Thus, any method may be used as long as this requirement is satisfied, and ejection may be performed by using the single pulse method both for the low-duty region and the high-duty region.

As described above, ejection control with different ejection speed vitiation, that is, the stable ejection for the low-duty region and the variable ejection for the high-duty region are used separately depending on the duty. As a result, the liquid ejecting method, the liquid ejecting device, and the liquid ejecting system which can prolong the life of the electro-thermal conversion element while maintaining the high quality image can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-037423, filed Feb. 27, 2014, which is hereby incorporated by reference wherein in its entirety.

What is claimed is:

1. A liquid ejecting device, comprising:

an ejecting unit provided with an electro-thermal conversion element and configured to eject a liquid to a medium by applying electric energy to the electro-thermal conversion element;

a determining unit configured to determine whether a region of the medium to which the liquid is ejected by the ejecting unit is a first region or a second region with a number of ejections per unit area smaller than that of the first region; and a control unit configured to control ejection by the ejecting unit by changing magnitude of the electric energy to be applied to the electro-thermal conversion element, wherein the control unit makes the electric energy to be applied to the electro-thermal conversion element relatively larger for the ejection to the region determined by the determining unit to be the first region and makes the electric energy to be applied to the electro-thermal conversion element relatively smaller for the ejection to the region determined by the determining unit to be the second region, and wherein the electric energy to be applied to the electro-thermal conversion element is applied with a pulse-shaped waveform, and the control unit executes control by changing the magnitude of the electric energy by changing a width of the pulse-shaped waveform.

2. The liquid ejecting device according to claim 1, wherein the control unit executes control with a single pulse-shaped waveform for the ejection to the second region and executes control with a plurality of pulse-shaped waveforms for the ejection to the first region.

3. The liquid ejecting device according to claim 1, wherein the control unit executes control with a plurality of pulse-shaped waveforms.

4. A liquid ejecting method comprising the steps of:

ejecting a liquid to a medium by applying electric energy to an electro-thermal conversion element;

determining whether a region of the medium to which the liquid is ejected in the ejecting step is a first region or a second region with a number of ejections per unit area smaller than that of the first region; and controlling ejection in the ejecting step by changing magnitude of the electric energy to be applied to the electro-thermal conversion element, wherein the controlling step makes the electric energy to be applied to the electro-thermal conversion element relatively larger for the ejection to the region determined to be the first region in the determining step and makes the electric energy to be applied to the electro-thermal conversion element relatively smaller for the ejection to the region determined to be the second region in the determining step, and wherein the electric energy to be applied to the electro-thermal conversion element is applied with a pulse-shaped waveform, and the controlling step executes control by changing the magnitude of the electric energy by changing a width of the pulse-shaped waveform.

5. The liquid ejecting method according to claim 4, wherein the controlling step executes control with a single pulse-shaped waveform for the ejection to the second region and executes control with a plurality of pulse-shaped waveforms for the ejection to the first region.

6. A liquid ejecting system, comprising:

an ejecting unit provided with an electro-thermal conversion element and configured to eject a liquid to a medium by giving electric energy to the electro-thermal conversion element: and an obtaining unit configured to obtain information relating to whether a region of the medium to which the liquid is ejected by the ejecting unit is a first region or a second region with a number of ejections per unit area smaller than that of the first region, wherein on the basis of the information obtained by the obtaining unit, ejection is performed with the energy to be applied to the electro-thermal conversion element made relatively larger for the ejection to the first region, and ejection is performed with the energy to be applied to the electro-thermal conversion element made relatively smaller for the ejection to the second region, and wherein the electric energy to be applied to the electro-thermal conversion element is applied with a pulse-shaped waveform, and control is executed by changing the magnitude of the electric energy by changing a width of the pulse-shaped waveform.

7. The liquid ejecting system according to claim 6, wherein control is executed with a single pulse-shaped waveform for the ejection to the second region and with a plurality of pulse-shaped waveforms for the ejection to the first region.

* * * * *